US007036949B2

(12) United States Patent
Srass et al.

(10) Patent No.: US 7,036,949 B2
(45) Date of Patent: May 2, 2006

(54) CEILING FAN WITH LIGHT ASSEMBLY

(75) Inventors: Hadi Srass, Arlington, TN (US); William F. Ulewicz, La Verne, CA (US)

(73) Assignee: Hunter Fan Company, Memphis, TN (US)

( * ) Notice: Subject to any disclaimer, the term of this patent is extended or adjusted under 35 U.S.C. 154(b) by 29 days.

(21) Appl. No.: 10/801,745

(22) Filed: Mar. 16, 2004

(65) Prior Publication Data

US 2005/0207140 A1 Sep. 22, 2005

(51) Int. Cl.
*F21V 33/06* (2006.01)

(52) U.S. Cl. ..... 362/96; 362/234; 362/404; 416/5

(58) Field of Classification Search ..... 362/96, 362/234, 404, 249, 351, 355, 361, 294; 416/5
See application file for complete search history.

(56) References Cited

U.S. PATENT DOCUMENTS

| | | | | |
|---|---|---|---|---|
| 4,342,073 | A * | 7/1982 | Ranten | 362/294 |
| 4,382,400 | A | 5/1983 | Sstutzman | 98/40 |
| 6,019,577 | A | 2/2000 | Dye | 416/5 |
| 6,160,956 | A | 12/2000 | Pelonis | 392/361 |
| 6,302,556 | B1 | 10/2001 | Filip | 362/96 |
| 6,428,188 | B1 * | 8/2002 | Magno et al. | 362/362 |
| 6,450,658 | B1 | 9/2002 | Tsuji et al. | 362/96 |
| 6,508,564 | B1 * | 1/2003 | Kuwabara et al. | 362/612 |
| 6,520,739 | B1 | 2/2003 | Tsuji | 416/5 |

* cited by examiner

*Primary Examiner*—Thomas M. Sember
(74) *Attorney, Agent, or Firm*—Baker Donelson

(57) ABSTRACT

A ceiling fan is disclosed having a motor (14), a radial array of fan blades (16) coupled to blade irons (18) mounted to the motor (14), a translucent motor housing (24), and a frame (20) positioned concentrically around the motor housing (24). The frame (20) and motor housing (24) connect to a plate (32) having a series of light sources (40) mounted to the plate (32) inboard of the motor housing (24) to illuminate the motor housing (24).

6 Claims, 2 Drawing Sheets

CEILING FAN WITH LIGHT ASSEMBLY

TECHNICAL FIELD

The present invention relates generally to ceiling fans, and more particularly to ceiling fans having light assemblies.

BACKGROUND OF THE INVENTION

Ceiling fans having an attachable light assembly have existed for many years. Ceiling fans with light assemblies may be used in the place of a light fixture mounted to the ceiling. Conventional ceiling fans with light assemblies typically include a motor, a motor housing, a plurality of blade irons that connect corresponding ceiling fan blades to the motor, and a light assembly connected to the motor housing.

Ceiling fan light assemblies typically have one or more light globes that attach to the ceiling fan. The light globe includes a translucent portion depending from the ceiling fan. One or more incandescent lights attach to the ceiling fan and are encased within the light globe. The incandescent lights radiate light through the light globe to illuminate the globe and the environment surrounding the light assembly. Incandescent lights or bulbs are often located near the center off the light globe and typically radiate light of a generally constant intensity, thus giving the globe an appearance of a constant intensity of light. To vary the aesthetic appearance of light globes, conventional light globes may include an ornamental design and may assume a variety of shapes and configurations.

To create a new lighting effect, a ceiling fan has been designed which does not require a light globe or a centrally located light source. Instead, a unique ceiling fan has been designed which mounts a series of light sources such as light emitting diodes closely adjacent to or on an edge of a translucent motor housing. The series of light sources radiates light onto the motor housing. The motor housing diffuses the light, creating an appearance of varying intensities of light around the circumference of the motor housing and giving the motor housing the unique effect of a glowing appearance. Accordingly, it is to the provision of such that the present invention is primarily directed.

BRIEF SUMMARY OF THE INVENTION

In a preferred form of the invention a ceiling fan comprises an electric motor, a plurality of blades coupled to the motor, a housing having at least a translucent portion with a peripheral edge, and a plurality of light sources mounted closely adjacent the edge of the translucent portion of the housing. With this construction, light emanating from each light source is directed onto the translucent portion to illuminate the housing.

Objects, advantages and features of the present invention will become apparent from a reading of the following detailed description of the invention and claims in view of the appended drawings.

DETAILED DESCRIPTION

Figure 1:
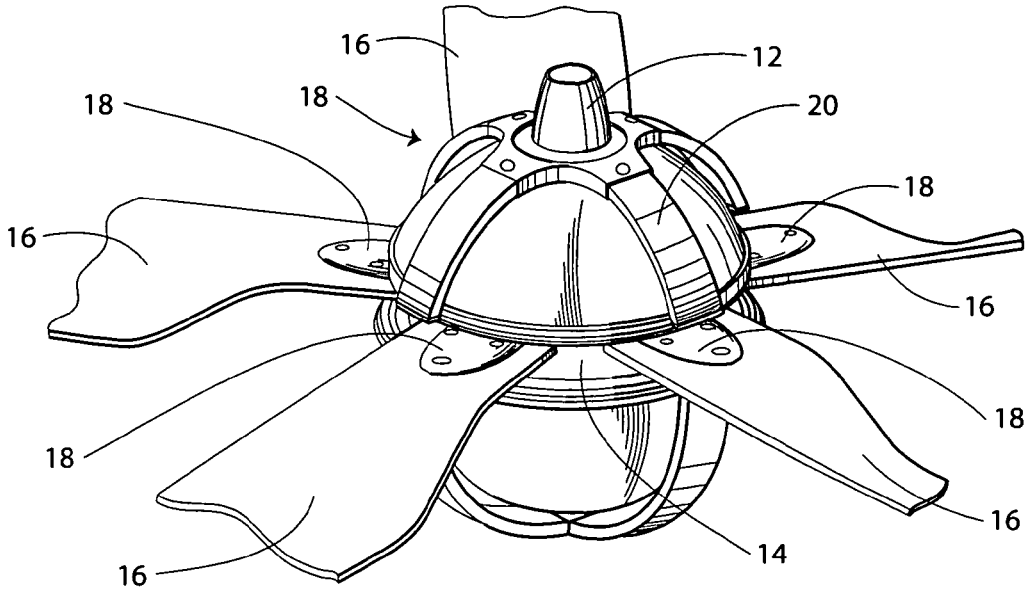
FIG. 1 is a perspective view of a ceiling fan embodying principles of the invention in a preferred form.
Figure 2:
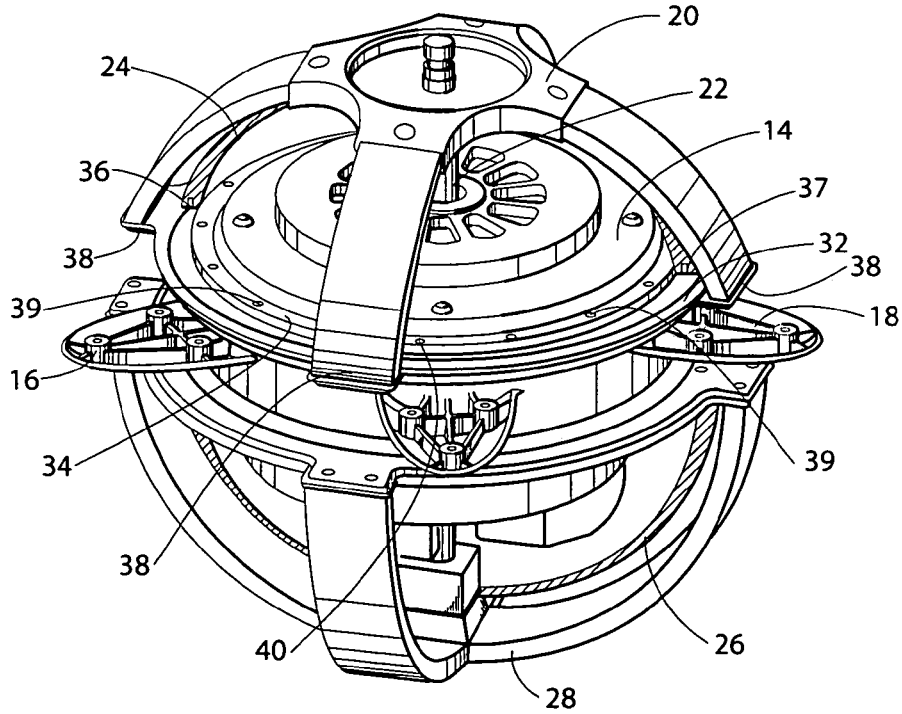
FIG. 2 is a perspective view, in partial cross-section, of the ceiling fan of FIG. 1.

With reference next to the drawings, there is shown in FIG. 1 a ceiling fan 10 in a preferred form of the invention. The ceiling fan 10 has a downrod 12 coupled to the top of a motor 14 to which is mounted a radial array of fan blades 16 through corresponding blade irons 18. The ceiling fan 10 has a four-armed upper frame 20 positioned above the motor 14 and blade irons 18. Referring to FIG. 2, a shaft 22 connects the motor 14 to the frame 20. A hemispherically shaped upper motor housing 24 is positioned concentrically within the upper frame 20. A corresponding hemispherically shaped lower motor housing 26 is positioned within a four-armed lower frame 28 below the motor 14 and blade irons 18. The upper motor housing 24 and the lower motor housing 26 are at least partially translucent or transparent and may be made of glass, plastic, crystal or other translucent material.

The blade irons 16 extend through an opening between the upper housing 24 and the lower housing 26. The blade irons 18 are coupled to the motor 14 at predetermined locations depending on the desired number of fan blades 16. Although the fan 10 is shown in the preferred embodiment with five blades 16, any number of fan blades may be used as dictated by convention. Thus, rotational motion produced by the motor 14 will produce air circulation through rotational movement of the fan blades 16.

An annular plate or top ring 32 is concentrically positioned around and spaced apart from the motor 14 and above the blade irons 18. A top surface 34 of the top ring 32 has a stepped configuration. A bottom edge 36 of the upper motor housing 24 abuts the top surface 34 of the top ring 32 adjacent the step. The top ring 32 has four mounting holes 37 through which mounting screws (unshown) are passed into the upper motor housing 24 to mount the upper motor housing 24 to the top ring 32. The top ring 32 has four flanges 38 that are aligned with and mounted to the bottom of the upper frame 20. The annular top ring 32 has a series or annular array of openings 39 closely adjacent the edge 36 of the upper housing 24. A light source 40, such as a light emitting diode, is mounted within each opening 39.

Figure 3:
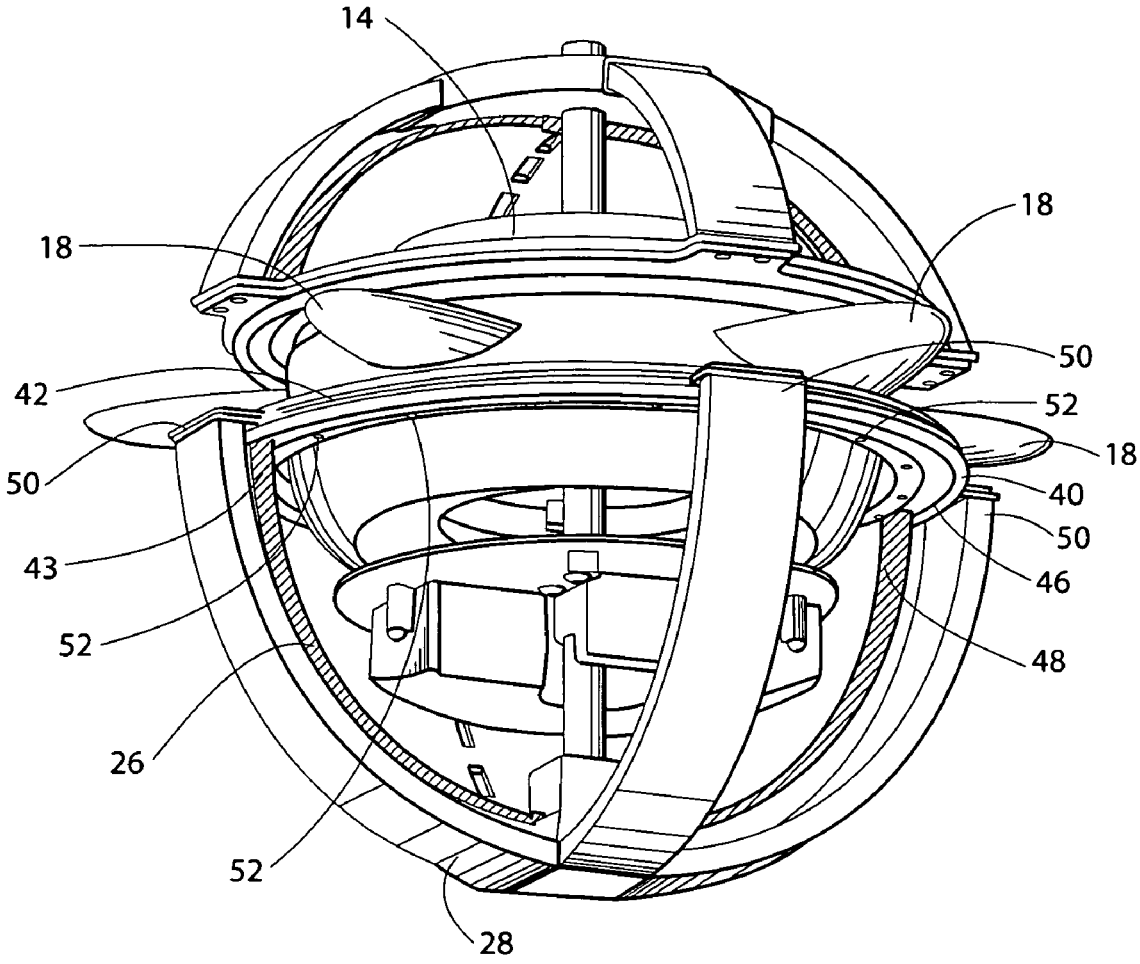
FIG. 3 is perspective view, in partial cross-section of the ceiling fan of FIG. 1.

In FIG. 3, an annular plate or bottom ring 42 is also concentrically positioned around and spaced apart from the motor 14 and below the blade irons 18. A bottom surface 46 of the bottom ring 42 has a stepped configuration. A top edge 48 of the lower motor housing 26 abuts the bottom surface 46 of the bottom ring 42 adjacent the step. The bottom ring 42 has four mounting holes 43 through which mounting screws (unshown) are passed into the lower motor housing 26 to mount the lower motor housing 26 to the bottom ring 42. The bottom ring 42 has four flanges 50 that are aligned with and mounted to the top of the lower frame 28. The annular bottom ring 42 has a series or annular array of openings 52 closely adjacent the edge 48 of the lower housing 26. Light source 40 is mounted within each opening 52.

In use, light L from the light sources 40 radiates through the openings 39 and 52 and onto the interior surface of the corresponding motor housing 24 and 26 so as to illuminate the upper and lower motor housings 24 and 26. The diffused light creates an appearance of varying intensities of light around the circumference of the motor housings 24 and 26, thus creating a unique and visually appealing illumination of the motor housings 24 and 26.

Figure 4:
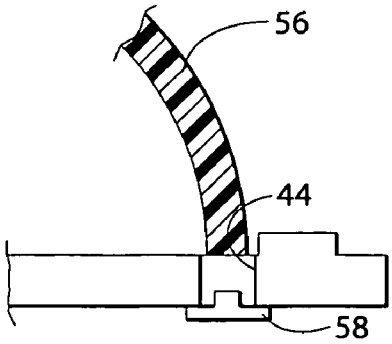
FIG. 4. is a perspective view, in partial cross section, of a ceiling fan embodying principles of the invention in an alternative form.

FIG. 4 shows an alternative embodiment of the invention. Here, the invention is substantially the same as that previously described in FIGS. 1-3, except that an edge 54 of a motor housing 56 is aligned directly upon a light source 58. Here, the light L is directed onto the edge 54 and diffuses through the translucent material in a slightly different way.

Figure 5:
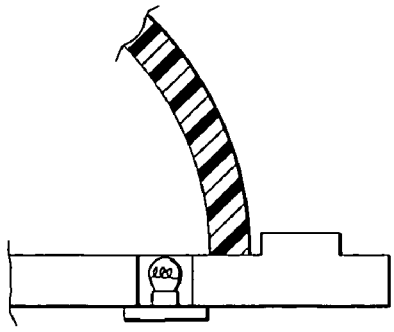
FIG. 5. is a perspective view, in partial cross section, of a ceiling fan embodying principles of the invention in an alternative form.

In another alternative embodiment, one could substitute the light emitting diodes with incandescent lights as shown in FIG. 5.

It should be understood that as the light in the just described invention illuminates the motor housing, it also illuminates a portion of the space of the environment surrounding the ceiling fan. Thus, the motor housing may also be considered to be a light fixture. Furthermore, the invention also may be used in connection with a light fixture or light kit which is separate from the motor housing.

It thus is seen that a ceiling fan having unique capabilities is now provided. While this invention has been described in detail with particular references to the preferred embodiments thereof, it should be understood that modifications, additions, and deletions, in addition to those expressly recited, may be made thereto without departure from the spirit and scope of the invention as set forth in the following claims.

The invention claimed is:

1. A ceiling fan comprising:

a motor;

a plurality of blades coupled to said motor;

a housing positioned about said motor having at least a translucent portion with a peripheral edge;

a plurality of light sources mounted closely adjacent said translucent portion edge; and a plate coupled to said housing, said plate having a series of openings, and wherein said light sources are mounted within said openings, whereby light emanating from the light source is directed onto the translucent portion to illuminate the housing.

2. The ceiling fan of claim 1 wherein said light sources are a series of light emitting diodes.

3. The ceiling fan of claim 1 wherein said light sources are a series of incandescent lights.

4. The ceiling fan of claim 1 wherein said light sources are mounted to emit light directly onto said edge of said translucent portion.

5. The ceiling fan of claim 4 wherein said light source is at least one light emitting diode.

6. The ceiling fan of claim 4 wherein said light source is incandescent.

* * * * *